US009510127B2

(12) United States Patent
Squires et al.

(10) Patent No.: US 9,510,127 B2
(45) Date of Patent: Nov. 29, 2016

(54) METHOD AND APPARATUS FOR GENERATING AN AUDIO OUTPUT COMPRISING SPATIAL INFORMATION

(71) Applicant: GOOGLE INC., Mountain View, CA (US)

(72) Inventors: John Squires, Newbridge (IE); Marcin Gorzel, Dublin (ID); Ian Kelly, Dublin (IE); Frank Boland, Dublin (IE)

(73) Assignee: Google Inc., Mountain View, CA (US)

( * ) Notice: Subject to any disclaimer, the term of this patent is extended or adjusted under 35 U.S.C. 154(b) by 38 days.

(21) Appl. No.: 14/410,975

(22) PCT Filed: Jun. 27, 2013

(86) PCT No.: PCT/EP2013/063569

§ 371 (c)(1),
(2) Date: Dec. 23, 2014

(87) PCT Pub. No.: WO2014/001478

PCT Pub. Date: Jan. 3, 2014

(65) Prior Publication Data

US 2015/0230040 A1 Aug. 13, 2015

(30) Foreign Application Priority Data

Jun. 28, 2012 (GB) ..... 1211512.7

(51) Int. Cl.
*H04R 5/00* (2006.01)
*H04S 7/00* (2006.01)

(52) U.S. Cl.
CPC ..... *H04S 7/302* (2013.01); *H04S 7/306* (2013.01); *H04S 2400/01* (2013.01); *H04S 2400/11* (2013.01); *H04S 2420/01* (2013.01); *H04S 2420/11* (2013.01)

(58) Field of Classification Search
CPC ..... H04R 5/02; H04S 7/301
See application file for complete search history.

(56) References Cited

U.S. PATENT DOCUMENTS

| | | | | |
|---|---|---|---|---|
| 6,766,028 | B1 * | 7/2004 | Dickens | H04S 3/004 381/17 |
| 7,231,054 | B1 | 6/2007 | Jot et al. | |
| 2004/0076301 | A1 * | 4/2004 | Algazi | H04S 7/304 381/17 |
| 2007/0009120 | A1 * | 1/2007 | Algazi | H04R 5/027 381/310 |
| 2008/0056517 | A1 * | 3/2008 | Algazi | H04S 7/304 381/310 |
| 2009/0067636 | A1 | 3/2009 | Faure et al. | |
| 2011/0208331 | A1 | 8/2011 | Sandler et al. | |
| 2011/0261973 | A1 | 10/2011 | Nelson et al. | |
| 2012/0014527 | A1 | 1/2012 | Furse | |

OTHER PUBLICATIONS

"Notification of Transmittal of the International Search Report and the Written Opinion of the International Searching Authority, or the Declaration," International Filing Date: Jun. 27, 2013, International Application No. PCT/EP2013/063569, Applicant: The Provost, Fellows, Foundation Scholars . . . , Date of Mailing: Sep. 23, 2013, pp. 1-11.

* cited by examiner

*Primary Examiner* — Simon King
(74) *Attorney, Agent, or Firm* — Brake Hughes Bellermann LLP

(57) ABSTRACT

A method of providing an audio signal comprising spatial information relating to a location of at least one virtual source (202) in a sound field with respect to a first user position comprises obtaining a first audio signal comprising a plurality of signal components, each of the signal components corresponding to a respective one of a plurality of virtual loudspeakers (200*a-e*) located in the sound field; obtaining an indication of user movement; determining a plurality of panned signal components by applying, in accordance with the indication of user movement, a panning function of a respective order to each of the signal components; and outputting a second audio signal comprising the panned signal components.

10 Claims, 7 Drawing Sheets

METHOD AND APPARATUS FOR GENERATING AN AUDIO OUTPUT COMPRISING SPATIAL INFORMATION

CROSS REFERENCE TO RELATED APPLICATIONS

This application is the national phase of International Application No. PCT/EP2013/063569, filed on Jun. 27, 2013, which claims priority to United Kingdom Application No. 1211512.7, filed Jun. 28, 2012. The contents of both prior applications are hereby incorporated in their entirety.

This invention relates to the field of audio signals, and more specifically to audio signals comprising spatial information.

It is desirable in many situations to generate a sound field that includes information relating to the location of sources (or virtual sources) within the sound field. Such information results in a listener perceiving a signal to originate from the location of the virtual source, i.e. the signal is perceived to originate from a position in 3-dimensional space relative to the position of the listener. For example, the audio accompanying a film may be output in surround sound in order to provide a more immersive, realistic experience for the viewer. A further example occurs in computer games, wherein audio signals output to the user comprise spatial information so that the user perceives the audio to come, not from a speaker, but from a (virtual) location in 3-dimensional space.

The sound field comprising spatial information may be delivered using headphone speakers through which binaural signals are received. The binaural signals comprise sufficient information to recreate a virtual sound field comprising one or more virtual sources. In such a situation, head movements of the user must be accounted for in order to maintain a stable sound field in order, for example, to maintain a relationship or synchronization or coincidence of audio and video. Failure to maintain a stable sound or audio field might, for example, result in the user perceiving a virtual source such as a car to fly into the air in response to a user ducking his head.

Additionally, maintenance of a stable sound field induces more effective externalisation of the audio field or, put another way, more effectively creates the sense that the audio source is external to the listener's head and that the sound field comprises sources localised at controlled locations. Accordingly, it is clearly desirable to modify a generated sound field to compensate for user movement, e.g. rotation or movement of the user's head in the x-, y-, and/or z-axis (when using the Cartesian system to represent space).

This problem can be addressed by detecting changes in head orientation using a head-tracking device and, whenever a change is detected, calculating a new location of the virtual source(s) relative to the user, and re-calculating the 3-dimensional sound field for the new virtual source locations. However, this approach is computationally expensive. Since most applications, such as computer game scenarios, involve multiple virtual sources, the high computational cost makes this approach unfeasible. Furthermore, this approach makes it necessary to have access to both the original signal produced by each virtual source as well as the current spatial location of each virtual source, which may also result in an additional computational burden.

Previous solutions to the problem of rotating or panning the sound field in accordance with user movement include the use of amplitude panned sound sources. Such solutions are available in commercial and open source audio engines.

However, these solutions result in a sound field comprising impaired distance cues as they neglect important signal characteristics such as direct-to-reverberant ratio, micro head movements and acoustic parallax with incorrect wavefront curvature. Furthermore, these previous solutions also give impaired directional localisation accuracy as they have to contend with sub-optimal speaker placements, for example 5.1 or 7.1 surround sound speaker systems which have not been designed for gaming systems.

It is therefore desirable to provide a less computationally expensive method for updating a sound field in response to user movement. Additionally, it is desirable to provide a method for updating a sound field that is suitable for use with arbitrary loudspeaker configurations.

In accordance with an aspect of the invention, there is provided a method of providing an audio signal comprising spatial information relating to a location of at least one virtual source in a sound field with respect to a first user position, the method comprising obtaining a first audio signal comprising a plurality of signal components, each of the signal components corresponding to a respective one of a plurality of virtual loudspeakers located in the sound field; obtaining an indication of user movement; determining a plurality of panned signal components by applying, in accordance with the indication of user movement, a panning function of a respective order to each of the signal components; and outputting a second audio signal comprising the panned signal components. In this manner a less computationally expensive method of updating a sound field comprising spatial information to compensate for user movement is provided.

Obtaining a first audio signal may comprise determining a location of a virtual source in the sound field, the location being relative to the first user position; and generating the signal components of the first audio signal such that the signal components combine to provide spatial information indicative of the virtual source location.

The virtual loudspeakers may correspond to the following surround sound configuration with respect to a user: a front left speaker; a front right speaker; a front centre speaker; a back left speaker; and a back right speaker.

In exemplary embodiments of the invention, the method further comprises determining, in accordance with the indication of user movement and the location of the virtual loudspeaker corresponding to the signal component, a respective order of the panning function to be applied to the component.

The indication of user movement may comprise an indication of an angular displacement of the user; and the panning function applied to the signal component corresponding to the ith virtual loudspeaker feed may be defined by:

$$g_i=(0.5+0.5\cos(\theta_i+\theta))^{m_i}$$

wherein

- $\theta_i$ is the angular position of the ith virtual loudspeaker feed;
- $m_i$ is the order of the panning function applied to the signal component corresponding to the ith virtual loudspeaker; and
- $\theta$ is the angular displacement of the user relative to the first user position.

Determining the respective order of the panning function may comprise, for each of a plurality of pairs of the virtual loudspeakers: determining, for at least one position:

a panning function order for the position that results in a predetermined gain; and interpolating the determined panning function orders to determine, for the angular displacement of the user, the respective order of the panning function to be applied to the signal component corresponding to each of the virtual loudspeakers.

According to a further aspect of the invention, there is provided a computer-readable medium comprising instructions which, when executed, cause a processor to perform a method as described above.

According to a further aspect of the invention, there is provided an apparatus for providing an audio signal comprising spatial information indicative of a location of at least one virtual source in a sound field with respect to a first user position, the apparatus comprising: first receiving means configured to receive a first audio signal, the first audio signal comprising a plurality of signal components, each of the signal components corresponding to a respective one of a plurality of virtual loudspeakers located in the sound field; second receiving means configured to receive an input of an indication of user movement; determining means configured to determine a plurality of panned signal components by applying, in accordance with the indication of user movement, a panning function of a respective order to each of the signal components received at the first receiving means; and output means configured to output a second audio signal comprising the determined panned signal components.

The determining means may be further configured to determine a location of a virtual source in the sound field, the location being relative to the first user position; generate the signal components such that the signal components combine to provide spatial information indicative of the virtual source location; and provide the generated signal components to the first receiving means.

The determining means may be further configured to perform any of the above-described methods.

According to a further aspect there is provided a computer implemented system for providing an audio signal comprising spatial information indicative of a location of at least one virtual source in a sound field with respect to a first user position, the apparatus comprising:

- a first module configured to receive a first audio signal, the first audio signal comprising a plurality of signal components, each of the signal components corresponding to a respective one of a plurality of virtual loudspeakers located in the sound field;
- a second module configured to receive an input of an indication of user movement;
- a determining module configured to determine a plurality of panned signal components by applying, in accordance with the indication of user movement, a panning function of a respective order to each of the signal components received at the first module; and
- an output module configured to output a second audio signal comprising the determined panned signal components.

In an exemplary embodiment of the invention, the determining means comprise a processor.

The present disclosure and the embodiments set out herein can be better understood with reference to the description of the embodiments set out below, in conjunction with the appended drawings which are:

Figure 5A:
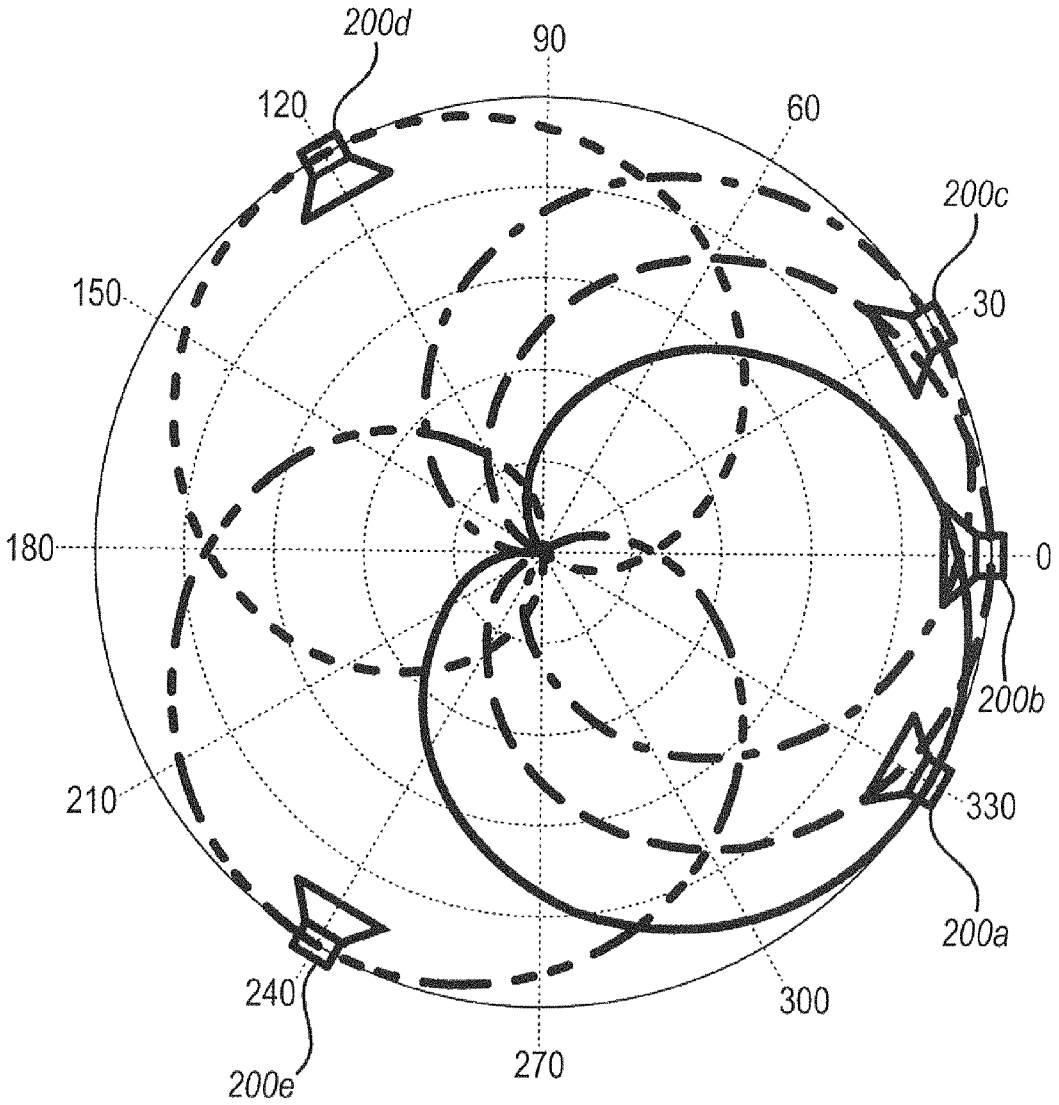
Figure 5B:
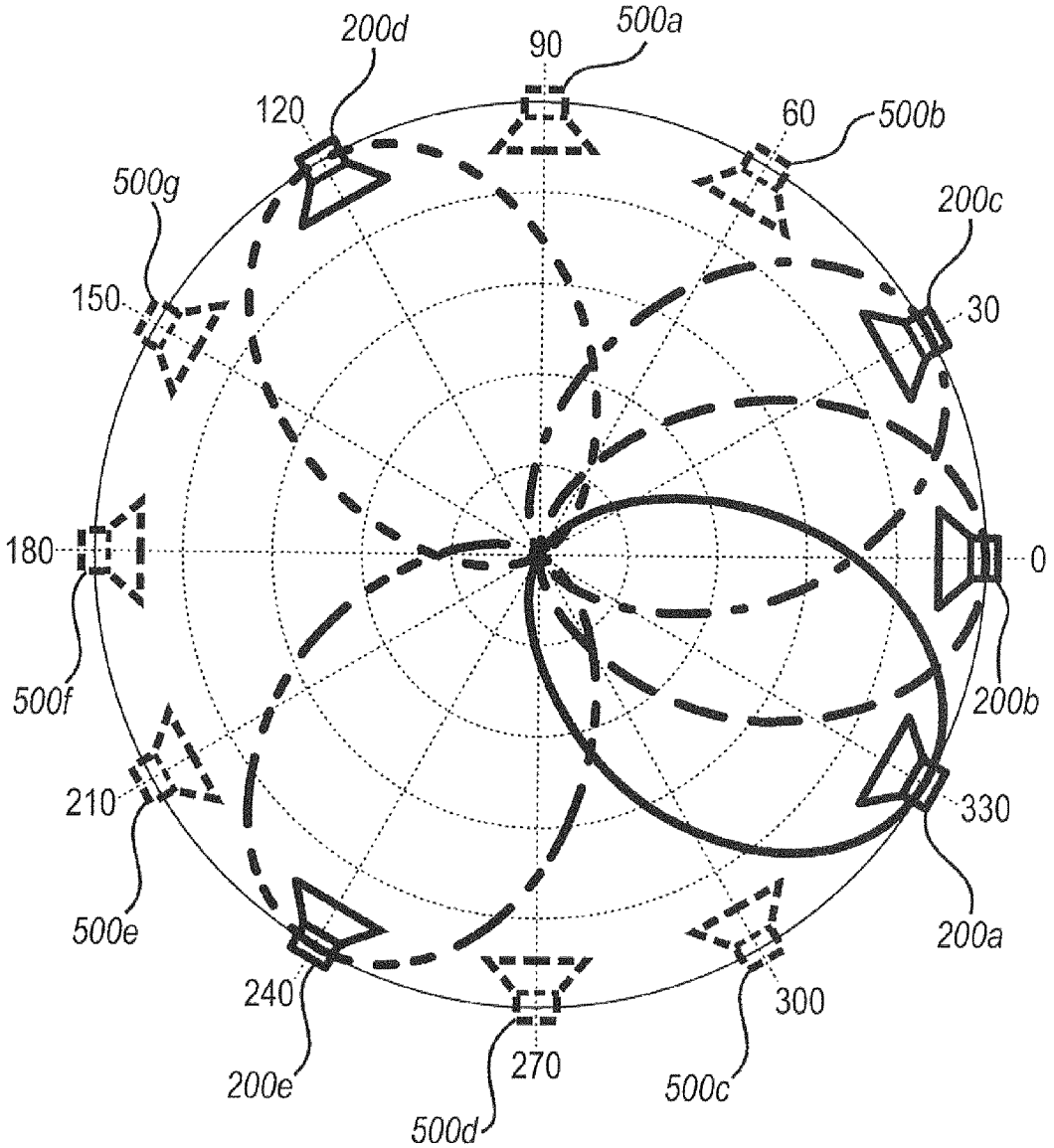
Figure 6:
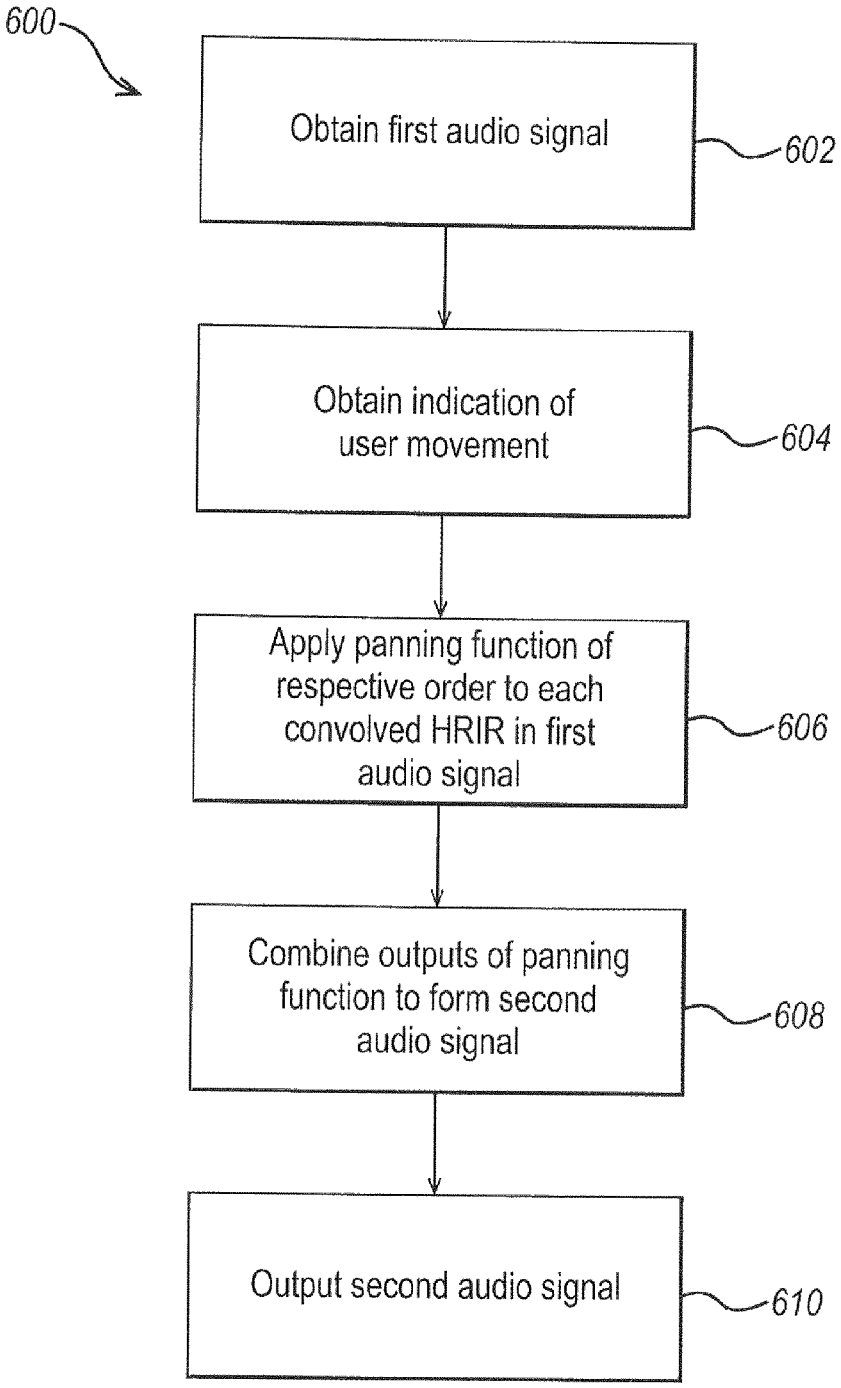
Figure 7:
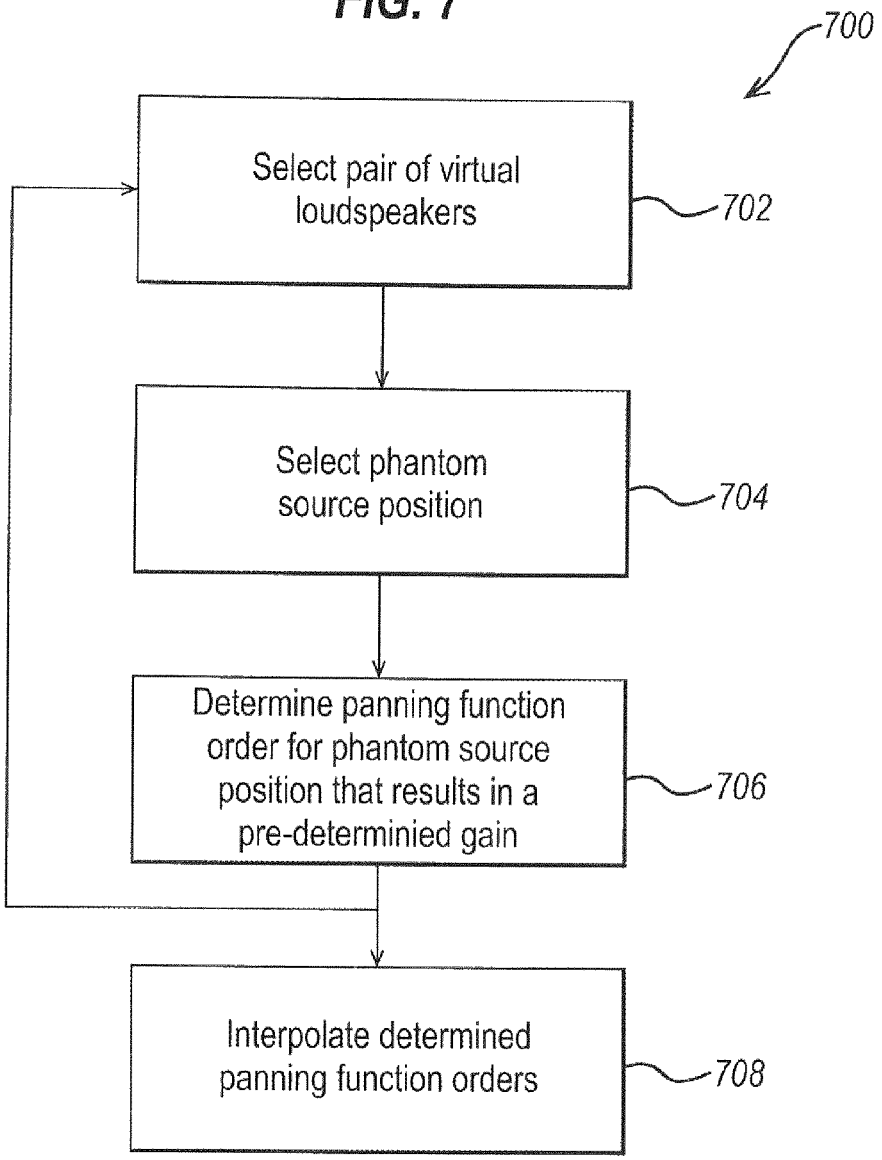

FIG. 5*a* is a representation of virtual microphone beams pointing at 5.0 speaker locations for first order "in-phase" Ambisonic decode components;

FIG. 5*b* is a representation of virtual microphone beams pointing at 5.0 speaker locations for fifth order "in-phase" Ambisonic decode components;

FIG. 6 is a flow chart showing a method of rotating a sound field;

FIG. 7 is a flow chart showing a method of determining a respective order of a panning function.

An audio signal is said to comprise spatial (or 3-dimensional) information if, when listening to the audio signal, a user (or listener) perceives the signal to originate from a virtual source, i.e. a source perceived to be located at a position in 3-dimensional space relative to the position of the listener. The virtual source location might correspond to a location of a source in an image or display relating to the audio. For example, an audio soundtrack of a computer game might contain spatial information that results in the user perceiving a speech signal to originate from a character displayed on the game display.

If, on the other hand, the audio signal does not comprise spatial information the user will simply perceive the audio signal to originate from the location at which the signal is output. In the above example of a computer game soundtrack, the absence of spatial information results in the user simply perceiving the speech to originate from the speakers of the system on which the game is operating (e.g. the speakers on a PC or speakers connected to a console).

Spatial information relating to a virtual source location is typically generated using an array of loudspeakers. When using an array of loudspeakers, the source signal (i.e. the signal originating from the virtual source) is processed individually for each of the loudspeakers in the array in accordance with the position of the respective loudspeaker and the position of the virtual source. This processing accounts for factors such as the distance between the virtual source location and the loudspeakers, the room impulse response (RIR), the distance between the user and the sound source and any other factors that may have a varying impact on the signal output by the loudspeakers depending on the location of the virtual source. Examples of how such processing may be performed are discussed in more detail below.

The processed signals form multiple discrete audio channels (or feeds) each of which is output via the corresponding loudspeaker and the combination of the outputs from each of the loudspeakers, which is heard by the listener, comprises spatial information. The audio signal produced in this manner is characterised in that the spatial or 3-dimensional (3D) effect works best at one user location which is known as the 'sweet spot'. There are many known methods for processing the loudspeaker feeds in order to include spatial information.

One well known technique for processing loudspeaker feeds to include spatial information is the use of time-delay techniques. These techniques are based on the principle that a signal emitted from a source reaches each element in a distributed array of sensors such as microphones at a different time. A distributed array of sensors is an array in which the sensors are distributed in 3-dimensional space (i.e. each sensor is located at a different physical location in 3-dimensional space. This time-difference (or time delay) arises because the signal travels a different distance in order to reach elements of the array that are father away from the source (because the time taken for the sound wave to reach the sensor is proportional to the distance traveled by the sound wave).

The difference in the distances traveled and, therefore the differences in the time of arrival of the signal at each of the array elements, is dependent on the location of the source relative to the elements of the array. Applying the same principle, spatial information can therefore be included in the output from an array of loudspeakers by processing each loudspeaker feed to include a delay corresponding to the location of the virtual source relative to the loudspeaker.

In many applications it is not desirable, or even possible, to output the audio signal via an array of loudspeakers. For example, the use of a loudspeaker array is impractical for users of portable devices or users sharing a common environment with users of other audio devices. In such situations it may be desirable to deliver the spatialized audio signal using binaural reproduction techniques either by headphones or by trans-aural reproduction for individual listeners.

Binaural reproduction techniques use Head Related Impulse Response (HRIRs) (referred to as Head Related Transfer Functions when operating in the frequency domain), which model the filtering effect of the outer ear, head and torso of the user on an audio signal. These techniques process the source signal (i.e. the signal originating from the virtual source) by introducing location specific modulations into the signal whilst it is filtered. The modulations and filtering are then decoded by the user's brain to localise the source of the signal (i.e. to perceive the source signal to originate for a location in 3D space).

Figure 1:
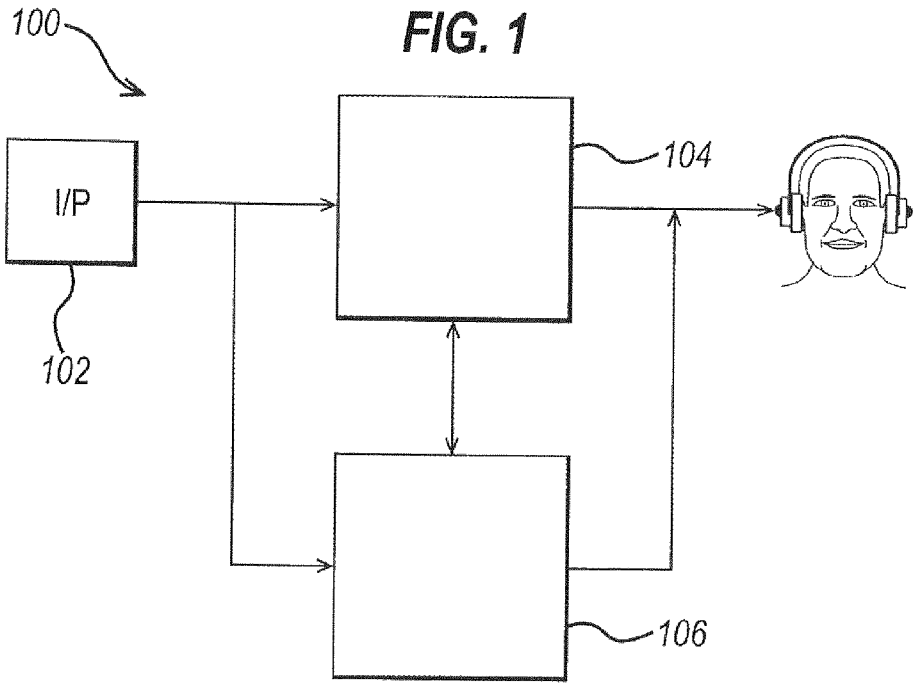
FIG. 1 is an audio processing system.

FIG. 1 shows an audio processing system 100 comprising an input interface 102, a spatial audio generation system 104, and a sound field rotation system 106. The spatial audio generation system 104 and the sound field rotation system 106 are inter-connected and both the spatial audio generation system 104 and the sound field rotation system 106 are connected to headphone speakers worn by a user. These connections may be wired or wireless. The spatial audio generation system 104 is configured to generate audio signals comprising 3-dimensional or spatial information and output this information to the user via the headphone speakers.

It will be appreciated that the spatial audio generation system 104 comprises any suitable system for generating an audio output comprising spatial information and outputting the generated audio to the user's headphone speakers. For example, the spatial audio generation system 104 may comprise a personal computer; a games console; a television or 'set-top box' for a digital television; or any processor configured to run software programs which cause the processor to perform the required functions.

The sound field rotation system 106 is configured to rotate a sound field generated by the sound field generation system 104 or input to the sound field rotation system via the input interface 102. In what follows, rotating a sound field is understood to comprise any step of modifying (or updating) a 3-dimensional sound field by moving (or adjusting) the location of the virtual sources within the sound field.

As with the spatial sound generation system 104, the sound field rotation system comprises any suitable system for performing the functions required to rotate a sound field. Whilst the spatial audio generation system 104 and the sound field rotation system 106 are depicted as separate systems in FIG. 1, it will be appreciated that these systems may alternatively be sub-components of a single audio processing system. Furthermore, both the audio generation system 104 and the sound field rotation system 106 may be implemented using software programs implemented by a processor.

Figure 2:
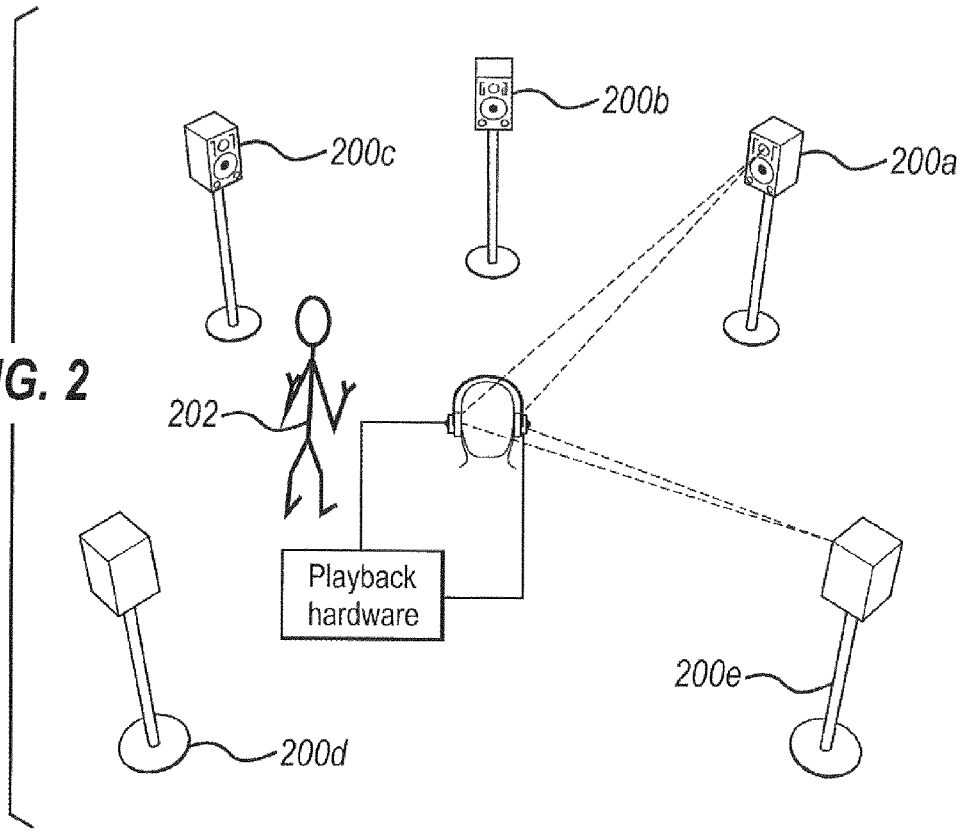
FIG. 2 is a virtual loudspeaker array used to generate binaural audio signals.

FIG. 2 shows an example of an array of loudspeakers (200*a-e*). The configuration of the loudspeaker array is used to simulate a virtual array of loudspeakers for generating a binaural audio signal comprising spatial information. The loudspeaker array 200 corresponds to an International Telecommunication Union (ITU) 5.1 surround sound array. Such an array comprises five loudspeakers 200*a-e*, generally comprising front right loudspeaker 200*a*, front centre loudspeaker 200*b*, front left loudspeaker 200*c*, surround-left loudspeaker 200*d* and surround-right loudspeaker 200*e*. It will be appreciated that a seven loudspeaker array corresponding to an ITU 7.1 surround sound array, or any other suitable loudspeaker array configuration might alternatively be used.

As discussed in more detail below, a multi-channel virtual source signal is generated or rendered in accordance with the configuration of the loudspeaker array 200 and the location of the virtual source 202. The virtual loudspeaker feeds are then generated by convolving each loudspeaker feed in the multi-channel virtual source signal with the HRIR for the corresponding loudspeaker. The resulting signal then comprises further 3-dimensional information relating to the characteristics of one or both of the room and the user. The user listening, via headphones, to the combined output of the virtual loudspeaker feeds therefore perceives the audio to originate from the location of the virtual source 202 and not the headphone speakers themselves.

Figure 3:
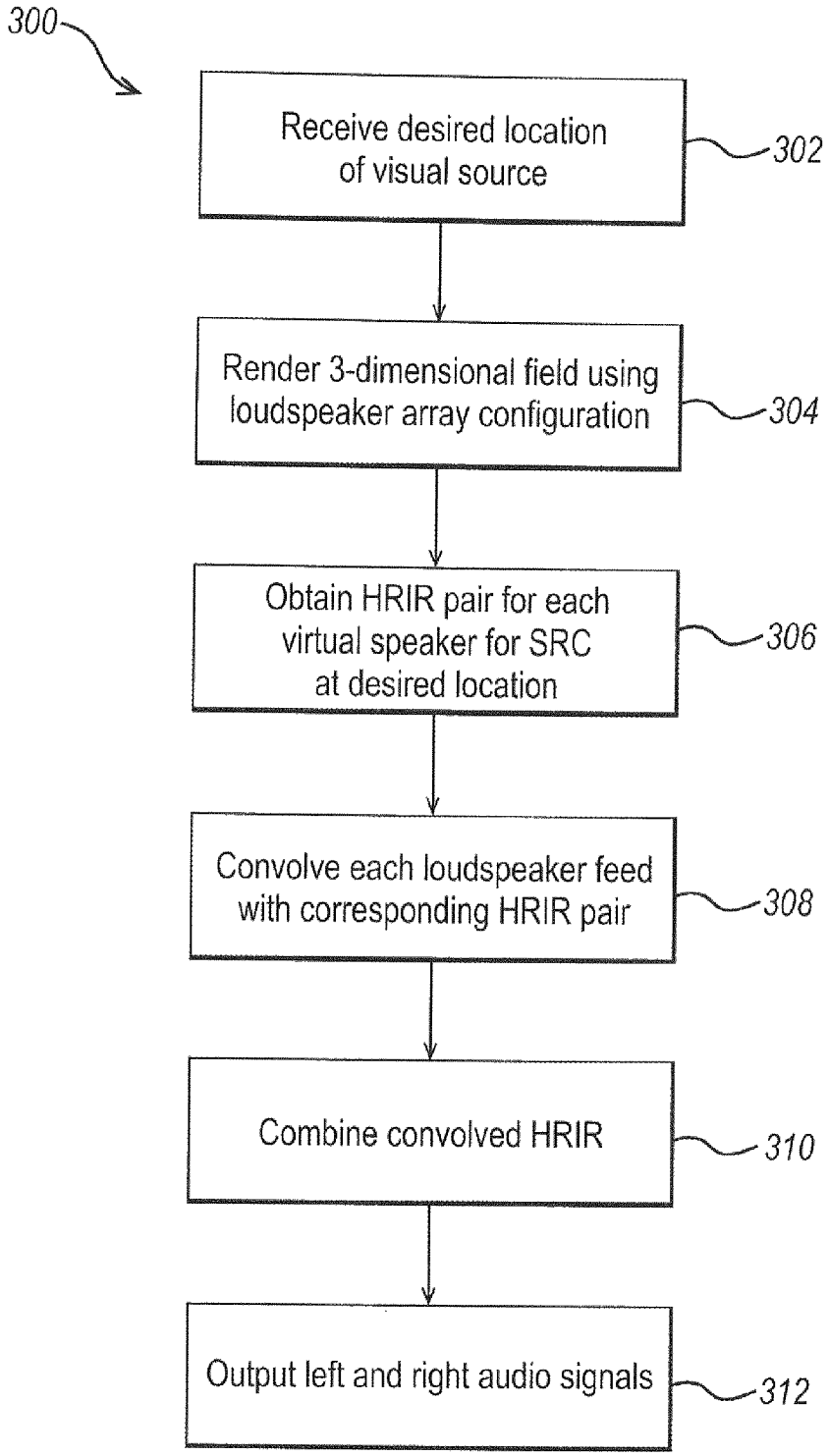
FIG. 3 is a flow chart showing a method of generating an audio signal comprising spatial information.

FIG. 3 is a flow chart showing a method of generating an audio signal comprising spatial information. At block 302, a desired location of a virtual source is received. As discussed above, the desired location of the virtual source may correspond to a location of the source in an image displayed to the user. This location may then be received by the spatial audio generation system via the input 102.

Alternatively, the spatial audio generation system 104 may determine the desired location of the virtual source. For example, if the user is watching a film and the virtual source is a dog barking in the foreground of the film image, the spatial audio generation system 200 may determine the location of the dog using suitable image processing techniques.

At block 304, a sound field comprising spatial information about the location of the virtual source 202 is firstly generated using the locations of the loudspeakers 202*a-e*. As discussed above, this sound field is generated by generating a signal or feed for each loudspeaker 200*a-e* in accordance with the location of the virtual source 202 and the location (or position) of the respective loudspeaker. For example, the feed for each loudspeaker 200*a-e* may comprise a delayed version of the virtual source signal, wherein the delay included in the signal corresponds to (or is proportional to) the relative difference in distances traveled by the source signal in order to reach the respective microphones (i.e. the use of Time Difference of Arrival or TDOA techniques). In this manner, a multi-channel signal virtual source signal is generated, wherein the multi-channel signal comprises spatial information regarding the location of the virtual source 202.

In block 306, the spatial audio generation system 104 determines a set (or pair) of HRIRs for each loudspeaker 200*a-e* in the speaker array 200. Each pair of HRIRs comprises a HRIR for the respective loudspeaker 200*a-e* for the left headphone speaker and a HRIR for the respective loudspeaker 200*a-e* for the right headphone speaker. The HRIRs are dependent on the location of the virtual loudspeaker, the user location and physical characteristics, as well as room characteristics.

It will be appreciated in what follows that any references to a HRIR apply equally to a Head Related Transfer Function HRTF, which is simply the frequency domain representation of the HRIR. It will also be appreciated that a step of convolving a HRIR with a signal might equally comprise multiplying the HRTF with a frequency domain representation of the signal (or a block of the signal).

In an exemplary embodiment of the invention, the spatial audio generation system 104 receives the HRIR pairs via the input interface 201. For example, a user may manually select HRIR pairs from a plurality of available HRIR pairs. In this manner, a user can select HRIR pairs that are suited to individual body characteristics (e.g. torso dimensions, head size etc) of the particular user. In an alternative embodiment of the invention, the spatial audio generation system 104 generates the HRIR pairs for each of the loudspeakers 200*a-e* using any suitable method. For example, the spatial audio generation system 104 may use a look-up table to determine or obtain the HRIR pairs.

At block 308, the spatial audio generation system 104 convolves each of the loudspeaker feeds (i.e. the signals resulting from processing the virtual source signal for each of the loudspeakers 200*a-e*) with the left and right HRIR obtained for the respective loudspeaker 200*a-e*. The signals resulting from convolving the left HRIR for each loudspeaker 200*a-e* with the loudspeaker feeds comprise the left binaural signals, whilst the signals resulting from convolving the right HRIR for each loudspeaker 200*a-e* with the loudspeaker feeds comprise the right binaural signals.

At block 310, the spatial audio generation system 104 combines the left binaural signals to form a left headphone channel feed (or signal to be output via the left headphone speaker). Similarly, the spatial audio generation system 104 combines the right binaural signals to produce the right headphone channel feed (or signal to be output via the right headphone speaker).

At block 312, the spatial audio generation system 104 then outputs the left and right headphone channel feeds to the left and right headphone speakers respectively. In this manner, the audio signals output via the left and right headphone speakers comprise spatial information relating to one or more virtual sources located in the sound field. The user listening to the audio signal through the headphones therefore externalises the sound, or perceives the sound to originate from a physical location in space other than the headphone itself. Thus, a three-dimensional sound field is delivered to the user via the headphones.

It will be appreciated from the above, that the virtual loudspeaker feeds (and the binaural signal) are generated in accordance with a position of the virtual source 202. Accordingly, in order to maintain a stable sound field, these feeds (or signals) must be recalculated in order to compensate for user movement.

For example, the sound field may be offset (moved, panned, rotated in 3-dimensional space) by an angular distance corresponding to the angular movement of the user (e.g. the user's head) in order to generate a sound field that is perceived as stable or continuous by the user. This updating of the sound field can be performed by repeating the steps of method 300 each time the user's head orientation changes. In this manner, the entire sound field (or auditory scene) including each of the virtual sources located therein is panned in accordance with (or to compensate for) the user movement.

Users of systems providing 3-dimensional audio output are likely to change head orientation many times whilst using the system. For one thing, the 3-dimensional audio output provides a more realistic sound experience and users are therefore more likely to move in reaction to sounds perceived to come from different locations relative to their heads. For example, a user of a computer game might spontaneously duck in response to an approaching helicopter.

In these situations, it would therefore be necessary to repeatedly recalculate the 3-dimensional audio output at very short time intervals. Such repeated recalculation of the 3-dimensional audio output is computationally expensive and requires significant processor power. Furthermore, this re-calculation of the sound field requires the sound field rotation system 106 to have access to the virtual source signals, which may not be the case if the sound field rotation system 106 receives the original 3-dimensional sound field from the spatial audio generation system 104 or any other system via input interface 102.

As discussed above, there are many known methods of generating audio signals comprising spatial information. One such alternative method comprises the use of Ambisonics which comprises encoding and decoding sound information on a number of channels in order to produce a 2-dimensional or 3-dimensional sound field.

Figure 4:
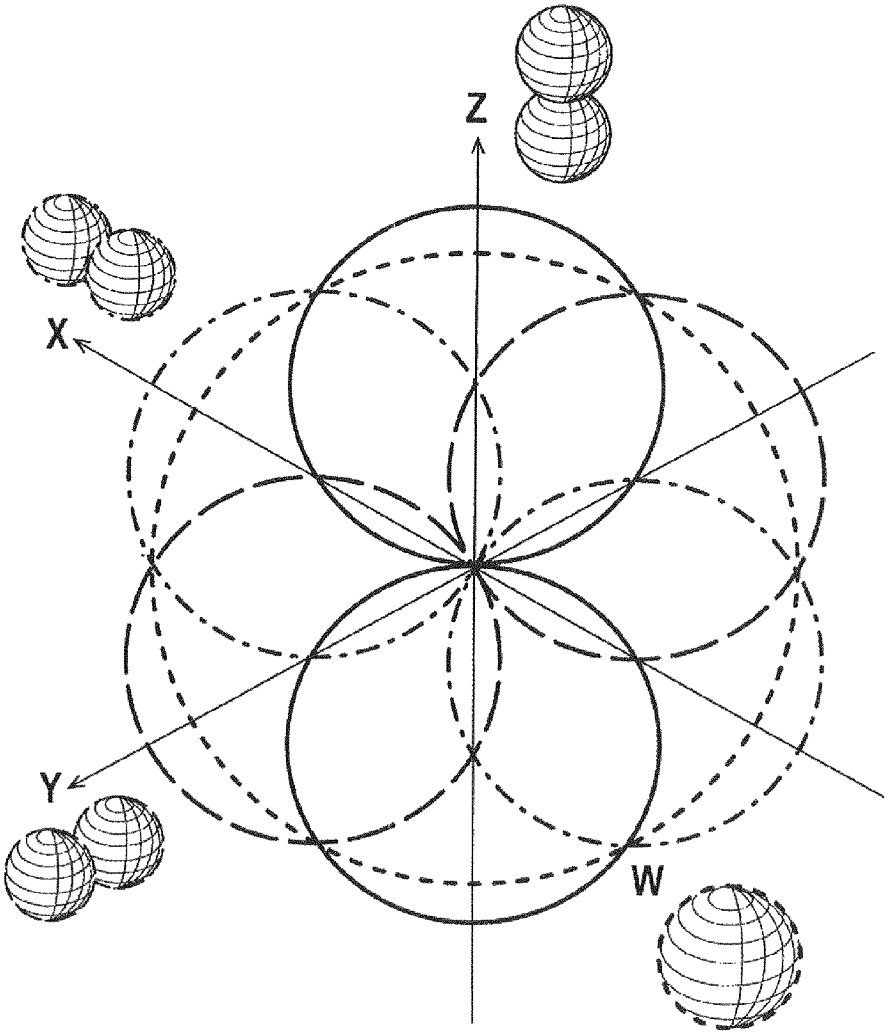
FIG. 4 is an illustration of Ambisonic components of the $1^{st}$ order.

FIG. 4 is a representation of Ambisonic components which provide a decomposition of spatial audio at a single point into spherical components. In first-order Ambisonics, sound information is encoded into four channels: W, X, Y and Z. This is called Ambisonic B-format The W channel is the non-directional mono component of the signal, corresponding to the output of an omnidirectional microphone. The X, Y and Z channels are the directional components in three dimensions, which correspond respectively to the outputs of three figure-of-eight microphones, facing forward, to the left, and upward. The W channel corresponds to the sound pressure at a point in space in the sound field whilst the X, Y and Z channels correspond to the three components of the pressure gradient.

The four Ambisonic audio channels do not correspond directly to, or feed, loudspeakers. Instead, loudspeaker signals are derived by using a linear combination of the four channels, where each signal is dependent on the actual position of the speaker in relation to the centre of an imaginary sphere the surface of which passes through all available speakers. Accordingly, the Ambisonic audio channels can be decoded for (or combined to produce feeds for) any loudspeaker reproduction array. Ambisonic decomposition therefore provides a flexible means of audio reconstruction.

In order to benefit from the flexibility provided by Ambisonic decomposition, the virtual loudspeaker signals generated by processing the feeds of virtual loudspeaker array 104 with HRIRs can be converted into B-Format Ambisonic signals (or components). Since the Low Frequency Effects, LFE, channel does not contribute to the directionality of the audio this channel can be incorporated into the final binaural signal delivered to the headphones without rotation. Hence, in the example where the array corresponds to an ITU 5.1 configuration, the sound field generated by the loudspeaker array can be treated as a sound field with five (or in the case of ITU 7.1, seven) sources.

In this example, viewing the discrete five loudspeaker signals as new sound sources, the surround sound field can be converted into a horizontal Ambisonics representation by multiplying each of the loudspeaker signals with a set of circular harmonic functions of a required order m. The respective B-format channels (or signals or components) corresponding to each of the loudspeaker signals can then be combined to form a unique set of B-format channels W, X, Y . . . fully describing the sound field.

Using matrix notation, the process of converting the loudspeaker signals from array 104 to B-format Ambisonic channels can be described as:

$$B = Y_{\theta} s_L$$

or $$\begin{bmatrix} W \\ X \\ Y \\ U \\ V \\ \vdots \\ \vdots \\ \vdots \end{bmatrix} = \begin{bmatrix} Y^1_{0,0}(\theta_L) & \dots & Y^1_{0,0}(\theta_{Rs}) \\ \vdots & \ddots & \vdots \\ Y^{\sigma}_{m,n}(\theta_L) & \dots & Y^{\theta}_{m,n}(\theta_{Rs}) \end{bmatrix} * \begin{bmatrix} L \\ R \\ C \\ Ls \\ Rs \end{bmatrix}$$

where:

B comprises the B-format channels W, X, Y for first order Ambisonics (and W, X, Y, U, V . . . for higher order ambisonics);

$s_L$ comprises the 5.0 channel feeds of the loudspeaker array; and $Y_{mn}^{\sigma}(\theta)$ comprises the circular harmonic functions that can be expressed as:

$$Y^{\sigma}_{mn}(\theta) = A_{mn} P_{mn} \begin{cases} \cos m\theta & \text{if } \sigma = +1 \\ \sin m\theta & \text{if } \sigma = -1 \end{cases}$$

where m is the order and n is the degree of the spherical harmonic and $P_{mn}$ is the fully normalized (N2D) associated Legendre function and $A_{mn}$ is a gain correction term (for N2D).

Using the above equations, the spatial sound field created using the signals from loudspeakers 200*a-e* (the sound field generated by combining the multi-channel virtual source signal) can be converted into a B-format representation of the sound field.

Rotation of an Ambisonics sound field (i.e. a sound field represented using Ambisonic decomposition) through an angle Θ around the z-axis can be performed easily by multiplying the B-format signals with a rotation matrix R(Θ) prior to the 'decoding stage' (i.e. prior to combination of the B-format signals to produce the sound field). The rotated (or panned) B-format signals B' can then be generated by:

$$B' = R(\Theta)B,$$

which, in the case of a 1st order sound field can be written as:

$$\begin{bmatrix} W' \\ X' \\ Y' \end{bmatrix} = \begin{bmatrix} 1 & 0 & 0 \\ 0 & \cos\theta & -\sin\theta \\ 0 & \sin\theta & -\cos\theta \end{bmatrix} \begin{bmatrix} W \\ X \\ Y \end{bmatrix}.$$

Accordingly, any sound field that is rendered using a uniform or non-uniform virtual loudspeaker configuration can be easily manipulated after conversion of the sound field to Ambisonic B-format representation. As discussed above, this conversion can be performed by interpreting each virtual loudspeaker feed as a virtual sound source and then encoding the resulting sound field into the Ambisonics domain in the standard way. Once this conversion has been performed rotation of the resulting Ambisonic sound field can be easily and efficiently performed by application of the above equation to obtain rotated B-format signals B'.

However, whilst any sound field can be converted to Ambisonic B-format representation in the above-described manner, conversion of sound fields generated by highly non-uniform loudspeaker arrays (such as ITU 5.1 or 7.1 arrays) is problematic. This is because a trade-off arises between the directional resolution that can be obtained and the degree of computational complexity required.

This trade-off is particularly important when dealing with computer game applications because rapid movements of the user mean that rotation of the sound field must be performed as quickly and efficiently as possible in order to avoid a lag between the user movement and the subsequent rotation. At the same time however, high directional resolution is required in order to produce a high quality audio experience for the user.

The Ambisonics decoding process can be considered in terms of virtual microphone beams pointing at each of the locations of the loudspeakers of the virtual array. The width of the microphone beams (and the resolution of the Ambisonic representation) depends on the order of the Ambisonic components.

FIG. 5*a* is a representation of virtual microphone beams 800*a-e* pointing at the 5.0 loudspeakers of the virtual array 200*a-e*. The virtual microphone beams 800*a-e* correspond to first order Ambisonic decode components. It can be seen that the use of first order beams results in very blurry acoustic images in the frontal stage (i.e. the area of the front centre loudspeaker 200*b*, front left loudspeaker 200*a* and the front right loudspeaker 200*c*), i.e. the width of virtual microphone beams 800*a-c* results in a beam corresponding to one loudspeaker also covering another loudspeaker. For example, beam 800*c* can be seen to encompass both loudspeaker 200*c* and loudspeaker 200*a*; beam 800*b* can be seen to encompass all of loudspeakers 200*a-c*; and beam 800*a* can be seen to encompass loudspeakers 200*a* and 200*b*.

These overlaps arise because the inter-loudspeaker spacing in the frontal stage is less than can be accurately decoded using first order Ambisonic components (i.e. spatial oversampling due to redundant loudspeakers). Subsequent re-rendering (or coding) of the sound field using Ambisonics will suffer from poor direction resolution.

On the other hand, the loudspeaker spacing at the back (i.e. the spacing between the loudspeakers 200*d* and 200*e*) is the maximum spacing that can be represented using first order Ambisonic components. This is because first order Ambisonics requires a minimum number of reproduction loudspeakers that is equal to the number of Ambisonic channels which in this case is three resulting in a maximum inter-loudspeaker spacing of 120°. Accordingly, the microphone beams 800*d* and 800*e* which respectively point at the surround left and surround right loudspeakers 200*d* and 200*e* provide suitable resolution for the spacing between these loudspeakers.

FIG. 5*b* is a representation of virtual microphone beams 900*a-e* pointing at the 5.0 loudspeakers of the virtual array 200*a-e*. The virtual microphone beams 900*a-e* correspond to fifth order Ambisonic decode components. It can be seen that these virtual microphone beams 900*a-e* have smaller lobes resulting in higher resolution. Each of the microphone beams 900*a-c* can be seen to encompass the respective loudspeakers 200*a-c*. Fifth order decode components are required in order to achieve similar localisation in the frontal stage area as can be achieved when using a 5.0 ITU array of loudspeakers. However, as can be seen in FIG. 5*b*, fifth order Ambisonic decode components requires a maximum loudspeaker separation of 30° in the decoding stage. Accordingly, the use of fifth order decode components requires a number of additional virtual loudspeakers 500*a-g*.

The number of additional virtual loudspeakers required 500*a-g* is greater than the number of loudspeakers 200*a-e* in the 5.0 virtual array 200. Accordingly, the extra loudspeakers 500*a-g* required for Ambisonic coding of the sound field results in a significant increase in computational cost with respect to the computational cost of the method 300 of generating the 3-dimensional audio output.

Ambisonic Equivalent Panning (AEP) was introduced by Neukom and Schacher in "*Ambisonic Equivalent Panning*", International Computer Music Conference 2008. In AEP the Ambisonic encoding and decoding phases are replaced with a construction of a set of panning functions:

$$g = (0.5 + 0.5\cos(\theta_i + \theta))^m = \left(\cos\frac{\theta}{2}\right)^{2m},$$

wherein $\theta_i$ is the angular position of the ith virtual loudspeaker feed;

m is the order of the panning function applied to the signal component corresponding to the ith virtual loudspeaker; and θ is the angular displacement or movement of the user (relative to the user position at which the 3-dimensional sound field was created).

FIG. 6 is a flow chart showing a method of rotating a sound field. At block 602 sound field rotation system 106 obtains a current (or first) audio signal (or sound field) from the spatial audio generation system 104. The first audio signal comprises 3-dimensional or spatial information generated, for example, in accordance with method 300 of FIG. 3.

At block 604, the sound field rotation system 106 obtains an indication of user movement. In some exemplary embodiments of the invention, the indication of user movement is received via the input interface 102 from a head tracker or other system capable of determining user movement or displacement. In an alternative example, the sound field rotation system 106 periodically receives an indication of a user position and, based on the received position indications, the sound field rotation system 106 determines user head displacement or movement.

At block 606, a panning function of a respective order is applied to the multi-channel virtual source signal. The panning function applied to each virtual loudspeaker feed (or channel) is:

$$g_i=(0.5+0.5\cos(\theta_i+\theta))^{m_i}$$

Wherein g is the gain applied to the ith virtual loudspeaker feed;

$\theta_i$ is the angular position of the ith virtual loudspeaker feed;

$m_i$ is the order of the panning function applied to the signal component corresponding to the ith virtual loudspeaker; and θ is the angular displacement of the user relative to the previous (or first) user position.

The panning function applied to each virtual loudspeaker feed pans the loudspeaker feed in response to the received indication of user movement. The order $m_i$ of the panning (or gain) function applied to each loudspeaker feed is determined in accordance with the inter-loudspeaker spacing. Accordingly, this panning function is suitable for use with non-uniform arrays such as the 5.0 array 200 shown in FIG. 2. In order to account for the non-uniformity of the array 200 higher order panning functions are applied to the loudspeakers at the frontal stage (i.e. the loudspeakers 200*a-c*) whilst lower order panning functions are applied to the loudspeakers at the back (i.e. the loudspeakers 200*d,e*).

For example, a fifth order panning function may be used to pan the right and left binaural signals resulting from loudspeakers 200*a-c*, whilst a first order panning function may be used to pan the right and left binaural signals resulting from loudspeakers 200*d, e*. In this manner, sufficient resolution can be achieved in the frontal stage area without a corresponding increase in computational efficiency.

In some exemplary embodiments of the invention, the order of the panning functions $m_i$ is dependent on the current head orientation, allowing for fractional values in transitional points between head orientations.

It can therefore be seen that the use of a variable order panning function provides a computationally efficient method of providing both sharp localisation in the front speakers and continuous panning in the surround or back speakers. Furthermore, the use of the variable order panning function means that the left and right binaural signals corresponding to each loudspeaker 200*a-e* respectively can be updated (or rotated in 3-dimensional space) without re-convolving the HRIRs with the virtual source signals.

At block 608, the spatial field rotation system 106 combines the panned virtual loudspeaker feeds (i.e. the outputs of the panning function applied to each of the virtual loudspeaker feeds) to form a rotated or updated, spatial audio field (or audio signal comprising 3-dimensional or spatial information).

At block 610, the spatial field rotation system 106 then outputs the left and right rotated audio signals to the left and right headphone channels respectively. The user listening to the output of the headphone speakers perceives the sound field to remain stable and, accordingly, perceives that the virtual source signal continues to originate from the virtual source location as no movement of the virtual source location relative to the user takes place.

The order of panning function for a given virtual loudspeaker can be determined using a number of alternative criteria. A suitable order for use with the panning function depends on both the loudspeaker direction and the current user head orientation or position (i.e. the head orientation or position after movement by the user).

The panning function orders may be determined by the sound field generation system 106 at block 606 of method 600, i.e. when applying the panning functions.

Alternatively, the panning function orders may be determined (or pre-calculated) for a set of predetermined user head orientations during a calibration phase (or before generation of the first sound field). In this case, the sound field rotation system 106 uses the predetermined or pre-calculated values (for example using a look-up table) when applying the panning functions. Similarly, interpolation can be used to determine a suitable panning function order for head orientations other than the pre-calculated values. It will be appreciated that in this case, the number of calculations performed for each head movement is reduced.

FIG. 7 is a flow chart showing one exemplary method 700 of determining a suitable order of the panning function to be applied to a binaural signal corresponding to a respective virtual loudspeaker. The method 700 may be performed by the sound field rotation system 106. Alternatively, the method 700 may be performed by any other system and input to the sound field rotation system 106 via the input interface of via the spatial audio generation system 104.

At block 702, a pair of virtual loudspeakers 200*a-e* is selected. The selected pair may be, but are not necessarily, neighbouring loudspeakers in the virtual array 200.

At block 704, a phantom source position is then selected. A phantom source is a 'trial' or initial virtual source value used to begin an iterative process of selecting a suitable panning function order.

At block 706, a panning function order is selected for the selected phantom source position. The selected panning function order is the order that, for the given phantom source location, results in a predetermined gain.

In an exemplary embodiment of the invention, a phantom source position is selected to be an equal distance from each loudspeaker of the pair of loudspeakers selected at block 702. A source emitting (or outputting) a signal at the phantom source position will result in an equal gain being applied to each of the loudspeaker signals. This is because the distance traveled by the signal to reach each of the loudspeakers is the same and, accordingly, the signal received at each of the loudspeakers resulting from the phantom source is the same. Similarly, a phantom source located twice as close to a first loudspeaker of the pair as to the second loudspeaker of the pair (i.e. the ratio of distances between the phantom source and the first loudspeaker and the phantom source and the second loudspeaker is 2:1) will result in a gain applied to the first loudspeaker being twice the gain applied to the second loudspeaker. Accordingly, it will be appreciated that a phantom source positioned at a specific location between first and second loudspeakers of a pair of loudspeakers will result in a respective predetermined gain being applied to each of the loudspeaker signals.

Using the example of a source located an equal distance from both of the pair of loudspeakers, a suitable panning function order $m_i$ is then found iteratively by varying the beam width (i.e. the panning function order) until an equal gain of −3 dB is applied to each of the selected loudspeakers. This procedure is the repeated for each pair of loudspeakers in the array 200. This embodiment may be implemented using the following algorithm:

1. Determine the angular positions of the selected virtual loudspeakers, e.g. $\theta_1$ and $\theta_2$, and calculate their spread as $\theta_s=|\theta_1-\theta_2|$;
2. Set $m_i=0$;
3. Set $\Delta m>0$ (where $\Delta m$ is a small increment, e.g. $\Delta m=0.01$);
4. Evaluate $g=(0.5+0.5\cos\theta)^m$ for $$\theta=\frac{\theta_s}{2};$$

5. Repeat $m=m+\Delta m$ until $g\cong 0.7071\ldots(-3\text{ dB})$;
6. Select next loudspeaker pair and repeat.

The method 700 is then repeated for a number of phantom source positions in the virtual loudspeaker array 200. For example, the method is repeated for positions between one or more of the following loudspeaker pairs 200*a* and 200*b*; 200*b* and 200*c*; 200*c* and 200*d*; 200*d* and 200*e*; 200*e* and 200*a*. Then, at block 708, panning function orders for the remaining angles are determined by interpolating the previous results. For example, exponential interpolation can be applied and $m_i$ can be expressed for each loudspeaker location $\theta_i$ in the form:

$$m_i=A|\theta-\theta_i|^B+C$$

Where $\theta$ is the current head orientation and A, B and C are constants. Then, a gain function for each original channel feed can be then expressed as:

$$g_i=(0.5+0.5\cos(\theta_i+\theta))^{m_i}$$

The rotated feed for each virtual loudspeaker is a sum of the contributions of all the individual channel feeds at that given virtual loudspeaker angle and can therefore be expressed as:

$$s'=Gs$$

or $$\begin{bmatrix} L' \\ R' \\ C' \\ Ls' \\ Rs' \end{bmatrix}=\begin{bmatrix} g_{1,1} & \cdots & g_{1,5} \\ \vdots & \ddots & \vdots \\ g_{5,1} & \cdots & g_{5,5} \end{bmatrix}\begin{bmatrix} L \\ R \\ C \\ Ls \\ Rs \end{bmatrix}$$

Where s' are 5.0 channel signals after rotation, G is the rotation matrix and s are initial 5.0 channel signals.

The embodiments in the invention described with reference to the drawings comprise a computer apparatus and/or processes performed in a computer apparatus. However, the invention also extends to computer programs, particularly computer programs stored on or in a carrier adapted to bring the invention into practice. The program may be in the form of source code, object code, or a code intermediate source and object code, such as in partially compiled form or in any other form suitable for use in the implementation of the method according to the invention. The carrier may comprise a storage medium such as ROM, e.g. CD ROM, or magnetic recording medium, e.g. a floppy disk or hard disk. The carrier may be an electrical or optical signal which may be transmitted via an electrical or an optical cable or by radio or other means.

In the specification the terms "comprise, comprises, comprised and comprising" or any variation thereof and the terms include, includes, included and including" or any variation thereof are considered to be totally interchangeable and they should all be afforded the widest possible interpretation and vice versa.

It will be appreciated that the above description is by way of example only and that the order in which method steps are performed may be varied. Additionally, in exemplary embodiments of the invention some of the described steps may be omitted or combined with steps described in relation to separate embodiments.

The invention claimed is:

1. A method of providing an audio signal comprising spatial information relating to a location of at least one virtual source in a sound field with respect to a first user position, the method comprising:

obtaining a first audio signal comprising a plurality of signal components, each of the signal components corresponding to a respective one of a plurality of virtual loudspeakers located in the sound field, wherein obtaining the first audio signal comprises:

determining a location of a virtual source in the sound field, the location being relative to the first user position; and generating the signal components of the first audio signal such that the signal components combine to provide spatial information indicative of the virtual source location;

obtaining an indication of user movement;

determining, in accordance with the indication of user movement and the location of the virtual loudspeaker corresponding to the signal component, a respective order for each signal component;

determining a plurality of panned signal components by applying, in accordance with the indication of user movement, the panning function of the respective order to each of the signal components; and outputting a second audio signal comprising the panned signal components.

2. The method of claim 1, wherein the first and second audio signals comprise binaural signals.

3. The method of claim 1, wherein the virtual loudspeakers form a non-uniform array in the sound field.

4. The method of claim 1, wherein the virtual loudspeakers correspond to the following surround sound configuration with respect to a user:

a front left speaker;

a front right speaker;

a front centre speaker;

a back left speaker; and a back right speaker.

5. The method of claim 1, wherein the indication of user movement comprises an indication of an angular displacement of the user; and wherein the panning function applied to the signal component corresponding to the $i^{th}$ virtual loudspeaker feed is defined by:

$$g_i=(0.5+0.5\cos(\theta_i+\theta))^{m_i}$$

wherein $\theta_i$ is the angular position of the $i^{th}$ virtual loudspeaker feed;

$m_i$ is the order of the panning function applied to the signal component corresponding to the $i^{th}$ virtual loudspeaker; and $\theta$ is the angular displacement of the user relative to the first user position.

6. The method of claim 5, wherein determining the respective order of the panning function comprises for each of a plurality of pairs of the virtual loudspeakers:

determining, for at least one position a panning function order for the position that results in a predetermined gain; and interpolating the determined panning function orders to determine, for the angular displacement of the user, the respective order of the panning function to be applied to the signal component corresponding to each of the virtual loudspeakers.

7. A non-transitory computer-readable medium comprising instructions which, when executed, cause a processor to perform a method of providing an audio signal comprising spatial information relating to a location of at least one virtual source in a sound field with respect to a first user position, the method comprising:

obtaining a first audio signal comprising a plurality of signal components, each of the signal components corresponding to a respective one of a plurality of virtual loudspeakers located in the sound field, wherein obtaining the first audio signal comprises:

determining a location of a virtual source in the sound field, the location being relative to the first user position; and generating the signal components of the first audio signal such that the signal components combine to provide spatial information indicative of the virtual source location;

obtaining an indication of user movement;

determining, in accordance with the indication of user movement and the location of the virtual loudspeaker corresponding to the signal component, a respective order for each signal component;

determining a plurality of panned signal components by applying, in accordance with the indication of user movement, a panning function of a respective order to each of the signal components; and outputting a second audio signal comprising the panned signal components.

8. An apparatus for providing an audio signal comprising spatial information indicative of a location of at least one virtual source in a sound field with respect to a first user position, the apparatus comprising:

first receiving means configured to receive a first audio signal, the first audio signal comprising a plurality of signal components, each of the signal components corresponding to a respective one of a plurality of virtual loudspeakers located in the sound field, wherein the determining means are further configured to:

determine a location of a virtual source in the sound field, the location being relative to the first user position;

generate the signal components such that the signal components combine to provide spatial information indicative of the virtual source location; and provide the generated signal components to the first receiving means;

second receiving means configured to receive an input of an indication of user movement;

wherein the determining means are further configured to perform a method of determining, in accordance with the indication of user movement and the location of the virtual loudspeaker corresponding to the signal component, a respective order for each signal component;

determining means configured to determine a plurality of panned signal components by applying, in accordance with the indication of user movement, the panning function of the respective order to each of the signal components received at the first receiving means; and output means configured to output a second audio signal comprising the determined panned signal components.

9. The apparatus of claim 8, wherein the determining means comprise a processor.

10. A computer implemented system for providing an audio signal comprising spatial information indicative of a location of at least one virtual source in a sound field with respect to a first user position, the system comprising:

a first module configured to receive a first audio signal, the first audio signal comprising a plurality of signal components, each of the signal components corresponding to a respective one of a plurality of virtual loudspeakers located in the sound field;

a second module configured to receive an input of an indication of user movement;

a determining module configured to:

determine a location of a virtual source in the sound field, the location being relative to the first user position;

generate the signal components of the first audio signal such that the signal components combine to provide spatial information indicative of the virtual source location;

provide the generated signal components to the first receiving means;

determine, in accordance with the indication of user movement and the location of the virtual loudspeaker corresponding to the signal component, a respective order for each of the signal components, where the order is used as the exponent of a panning function to be applied to each of the signal components; and determine a plurality of panned signal components by applying, in accordance with the indication of user movement, the panning function of the respective order to each of the signal components received at the first module; and an output module configured to output a second audio signal comprising the determined panned signal components.

* * * * *